US012059041B1

(12) United States Patent
Saraceno

(10) Patent No.: US 12,059,041 B1
(45) Date of Patent: Aug. 13, 2024

(54) SPORT BRA AND SUPPORT BRA

(71) Applicant: Paula Saraceno, Denver, CO (US)

(72) Inventor: Paula Saraceno, Denver, CO (US)

( * ) Notice: Subject to any disclaimer, the term of this patent is extended or adjusted under 35 U.S.C. 154(b) by 430 days.

(21) Appl. No.: 17/400,470

(22) Filed: Aug. 12, 2021

(51) Int. Cl.
*A41C 3/00* (2006.01)

(52) U.S. Cl.
CPC ..... *A41C 3/0028* (2013.01); *A41C 3/0071* (2013.01)

(58) Field of Classification Search
CPC ..... A41C 3/0028; A41C 3/0071
See application file for complete search history.

(56) References Cited

U.S. PATENT DOCUMENTS 1,242,118 A * 10/1917 Anderman ..... A41C 3/02 450/77
1,878,755 A * 9/1932 Caldor ..... A41C 3/00 450/85
2,100,890 A * 11/1937 Witkower ..... A41C 3/00 450/59
2,118,378 A * 5/1938 Graham ..... A41C 3/00 450/86
2,378,908 A * 6/1945 Blum ..... A41C 3/00 450/39
2,388,757 A * 11/1945 Miller ..... A41C 3/00 450/84
2,440,922 A * 5/1948 Maurice ..... A41C 3/0078 450/1
2,455,036 A * 11/1948 Boylan ..... A41F 1/006 450/86
2,509,353 A * 5/1950 Johnson ..... A41C 3/0007 D2/707
2,521,373 A * 9/1950 Hutchison ..... A41C 3/00 450/85
2,650,363 A * 9/1953 Jack ..... A41C 3/0021 2/325
3,109,431 A * 11/1963 Jefferson ..... A41C 3/0007 450/86
3,131,696 A * 5/1964 Krakower ..... A41C 3/00 450/41
3,306,299 A * 2/1967 Paramore ..... A41C 3/0007 450/86
3,311,112 A * 3/1967 Murray ..... A41F 1/006 450/82
3,411,508 A * 11/1968 Sayers ..... A41C 3/0078 450/86

(Continued)

*Primary Examiner* — Gloria M Hale
(74) *Attorney, Agent, or Firm* — Edwin H. Crabtree

(57) ABSTRACT

A breast sport bra and a breast support bra for providing a women wearer with a comfortable breast support, a balance of the breasts, and freedom of movement, the breast support bra includes a first breast cup and a second breast cup. The breast cups are attached to a top portion of horizontal, elastic, breast cup band. The breast cup band is releasably attached the first and second breast cups for separating the cup one from another. A first shoulder strap is attached to a top portion of the first breast cup and an opposite end of the first shoulder strap is attached to a side of the second breast cup and an end portion of the breast cup band. A second shoulder strap is attached to a top portion of the second breast cup and an opposite end of the second shoulder strap crossing the first shoulder strap in an "X" configuration and attached to a side of the first breast cup and an end portion of the breast cup band.

7 Claims, 4 Drawing Sheets

(56) References Cited

U.S. PATENT DOCUMENTS 3,465,754 A * 9/1969 Lockwood ..... A41C 3/00 450/86
3,934,593 A * 1/1976 Mellinger ..... A41C 3/065 428/355 R
3,935,865 A * 2/1976 Newmar ..... A41C 3/0078 450/86
4,220,157 A * 9/1980 Clark ..... A41C 3/0021 450/86
4,300,568 A * 11/1981 Blanckmeister ..... A41F 1/006 450/85
5,914,166 A * 6/1999 Le ..... A41F 15/02 2/268
5,983,785 A * 11/1999 Schreiner ..... A47J 37/0857 99/393
6,200,194 B1 * 3/2001 Grier ..... A41F 1/006 450/64
6,257,951 B1 * 7/2001 DeMarco ..... A41C 3/10 450/55
6,257,952 B1 * 7/2001 Valentin ..... A41C 3/065 450/1
6,280,287 B1 * 8/2001 Keith ..... A41F 15/002 450/41
6,293,844 B1 * 9/2001 Dalton ..... A41C 3/00 450/86
6,302,761 B1 * 10/2001 Wrenn ..... A41C 3/0057 450/86
6,422,917 B1 * 7/2002 Rose ..... A41C 3/0014 450/86
6,547,363 B1 * 4/2003 Shinada ..... B41J 2/17523 347/85
6,896,582 B2 * 5/2005 Kawami ..... A41C 3/06 450/86
7,168,096 B1 * 1/2007 Landa ..... A41C 3/0021 450/86
D561,427 S * 2/2008 Saraceno ..... D2/706
8,167,679 B2 * 5/2012 Seraceno ..... A41C 3/02 450/86

* cited by examiner

SPORT BRA AND SUPPORT BRA

BACKGROUND OF THE INVENTION

(a) Field of the Invention

This invention relates to a women's bra, and more particularly, but not by way of limitation, to an improved breast sport bra and an improved breast support bra. The two types of bras disclosed herein provide women with comfortable breast support, balance of the breasts, freedom of movement, and helps reduce headaches, backaches, and related neck and shoulder pain.

This patent application incorporates by reference to the objects, advantages, and structural features of a Breast Supporter described in U.S. Pat. No. 8,167,679 to the subject inventor. This invention is a substantial improved bra, when compared to the patented Breast Supporter.

(b) Discussion of Prior Art

Heretofore, there have been a number of different types of support bras, sport bras, and the like, which are designed to compress the female breasts against the chest of a bra wearer and limit movement. The subject breast support bra and breast sport bra are designed to give the bra wearer comfort, and freedom of movement by using the natural force of gravity and the fulcrum and lever principal.

SUMMARY OF THE INVENTION

In view of the foregoing, it is a primary objective of the subject invention to provide a comfortable breast support and breast sport bra for women.

Another object of the invention is the support bra provides adjustable shoulder straps, using hook and loop fasteners, for quick adjustment to prevent the straps from digging into the wearer's shoulders. Also, the bra can be a non-adjustable sport bra, without adjustment straps and fastening points.

Still another object of the support bra and sport bra is the shoulder straps are designed to cross each other on a back of the wearer for improved balance of the breasts and comfort.

Yet another object of the invention is the front of the support bra includes an adjustable, breast cup band, using hook and loop fasteners, below a first and a second breast cup, for adjusting the bra under the breast cups.

The breast support bra includes a first and second breast cup attached to a top portion of a horizontal, elastic, breast cup band. The breast cup band is adjustable and can be opened and closed using a breast cup buckle. The breast cup buckle is mounted on one end of the elastic band with hook and loop fasteners mounted on an opposite end of the band.

The support bra also includes first and second straps attached to a top portion of the breast cups. The shoulder straps can be opened and closed using a shoulder strap buckle mounted on one end of the shoulder straps with hook and loop fasteners mounted on an opposite end of the shoulder straps.

These and other objects of the present invention will become apparent to those familiar with different types of women's support bras and sport bras, when reviewing the following detailed description, showing novel construction, combination, and elements as herein described, and more particularly defined by the claims, it being understood that changes in the embodiments disclosed herein are meant to be included within the scope of the claims, except insofar as they may be precluded by the prior art.

BRIEF DESCRIPTION OF THE DRAWINGS

The accompanying drawings illustrate complete preferred embodiments in the present invention according to the best modes presently devised for the practical application of the subject support bra, and in which.

DESCRIPTION OF THE PREFERRED EMBODIMENTS

Figure 1:
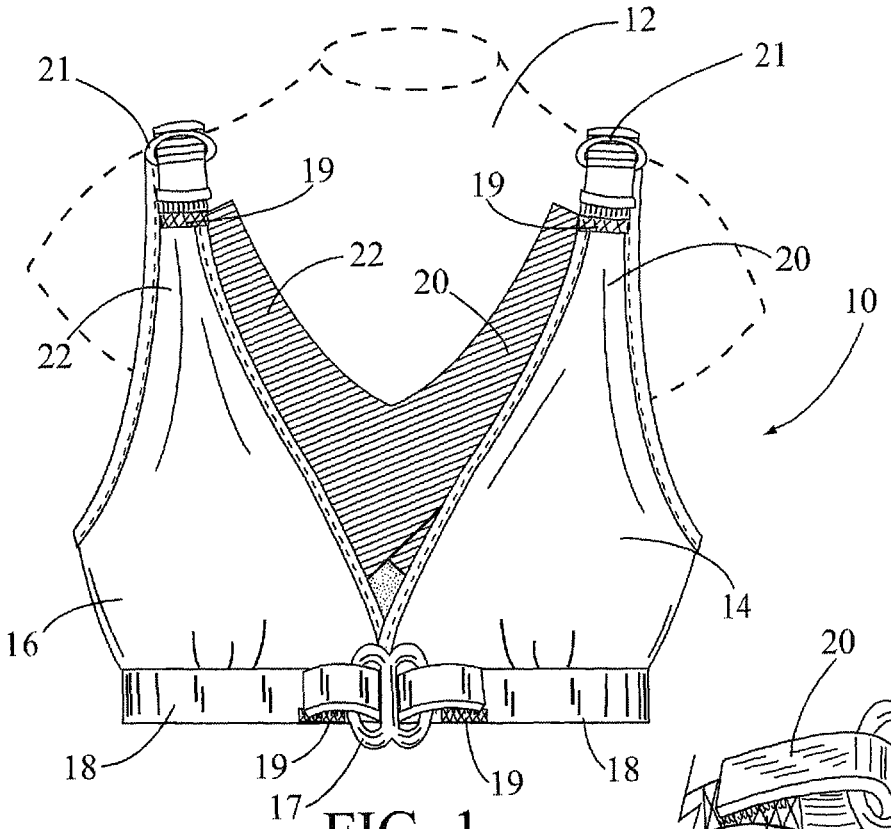
FIG. 1 is front view of the subject breast support bra.

In FIG. 1, a front view of the subject breast support bra is shown and having a general reference numeral 10. The support bra 10 is illustrated received on a female model 12, shown in dashed lines 12. The support bra 10 includes a first breast cup 14 disposed next to a second breast cup 16. A bottom portion of the two breast cups 14 and 16 are attached to a top portion of a horizontal, elastic, breast cup band 18. The breast cup band 18 is typically 1 inch wide.

Figure 1A:
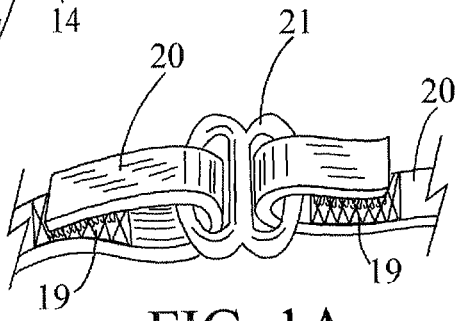
FIG. 1A is a perspective view of one of the shoulder straps with shoulder strap buckle and hook and loop fastener.
Figure 1B:
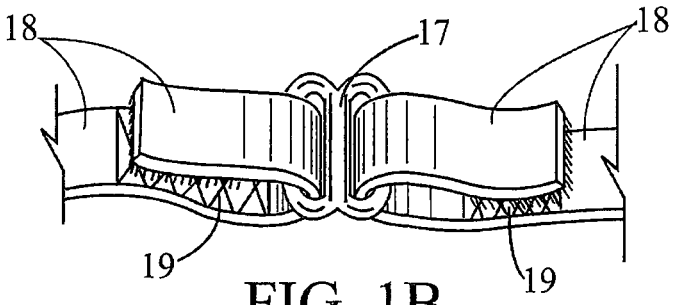
FIG. 1B is a perspective view of the breast cup band with buckle and hook and loop fasteners.

Referring now to both FIG. 1 and FIG. 1B, one end of the breast cup band 18 is threaded through a first loop in an adjustable breast cup buckle 17. An opposite end of the band 18 is threaded through a second loop in the buckle 17 and is attached to a portion of the band using hook and loop fasteners 19. By using the buckle 17 and the hook and loop fasteners 19, the breast cup band 18 allows the wearer of the support bar 10 to adjust a length of the band under the breast cups for added comfort to the wearer and separate the breast cups 14 and 16 from each other.

Referring now to both FIG. 1 and FIG. 1A, the support bra 10 also includes a first shoulder strap 20 attached to a top portion of the first breast cup 14. Also, a second shoulder strap 22 is attached to a top portion of the second breast cup 16. One end of the first shoulder strap 20 and one end of the second shoulder strap 22 are threaded through a first loop in a shoulder strap buckle 21 and attached to a side of the strap, using hook and loop fasteners 19. An opposite end of the first shoulder strap 20 and an opposite end of the second should strap 22 are threaded through a second loop in the shoulder strap buckle 21 and are attached to the strap using the hook and loop fasteners 19.

The feature of having releasable shoulder straps 20 and 22 allows the wearer of the support bra 10 to adjust the length of shoulder straps for added comfort and support of the wearer's breast and adjust for a balance of the breasts.

Figure 2:
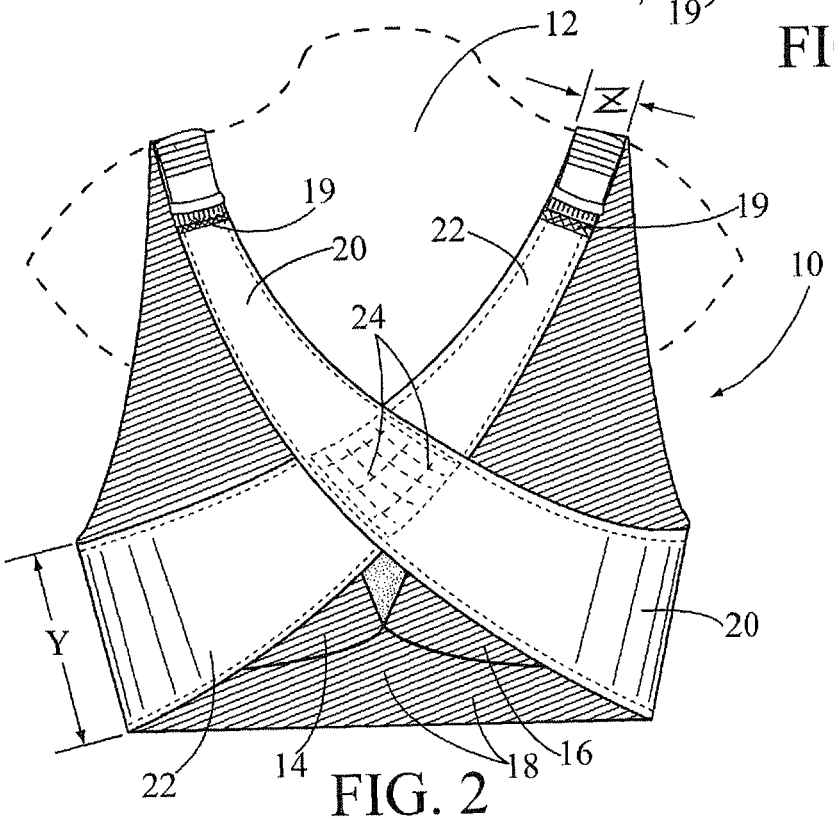
FIG. 2 is a rear view of the breast support bra shown in FIG. 1.

In FIG. 2, a rear view of the breast support bra 10 is shown. In this view, the first shoulder strap 20 can be seen crossing the second shoulder strap 22, in an "X" configuration and attached using treaded stitching 24. It should be noted, a bottom portion of the straps 20 and 22 have a width "Y" in a range from 3 to 4 inches in width and flare upwardly to a width "Z" in a range of ½ to 2 inches at a top portion of the straps. The feature of the shoulder straps provides for increased breast support, breast balance, and comfort against a back of the wearer. Also the width "Z" of the straps helps prevent the straps from digging into the top of the wearer's shoulders. Further, the crossing of the shoulder straps, shown in this drawing, need not include stitching 24.

Figure 3:
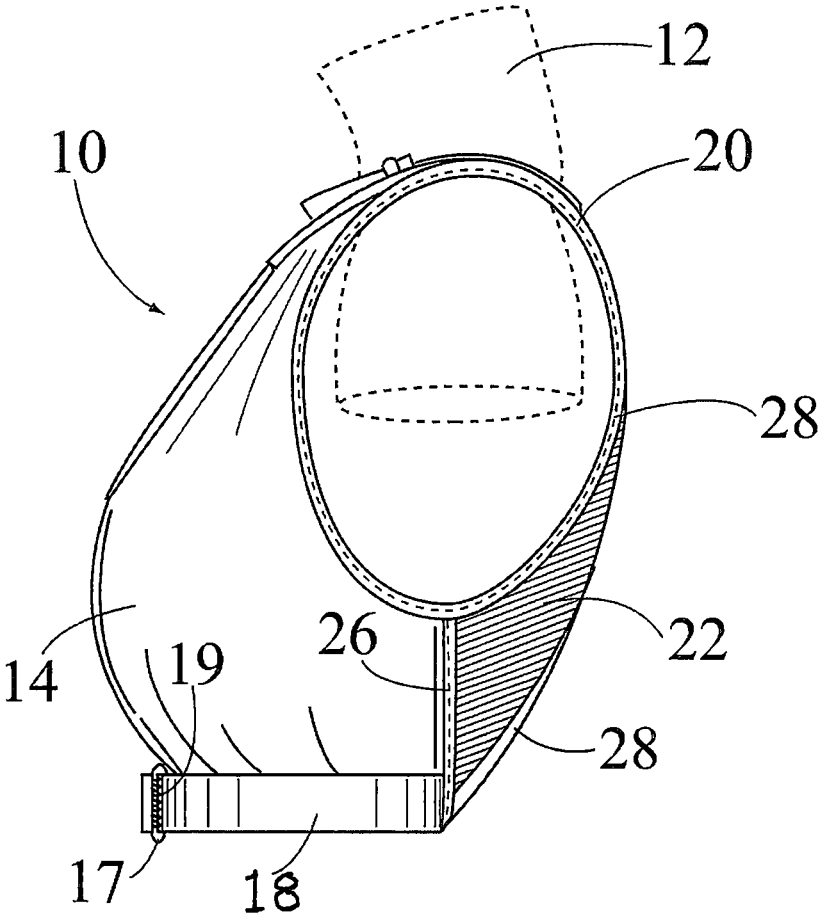
FIG. 3 is a side view of the support bra.

In FIG. 3, a side view of the breast support bra 10 is shown with a bottom portion of the second shoulder strap 22 attached to a side of the first breast cup 14 and attached to an end of the breast cup band 18 using a cover stitch seam 26. Fabric edges 28 of the support bra 10 include bindings folded over the elastic band 18. This feature adds strength to the fabric of the bra material.

Figure 4:
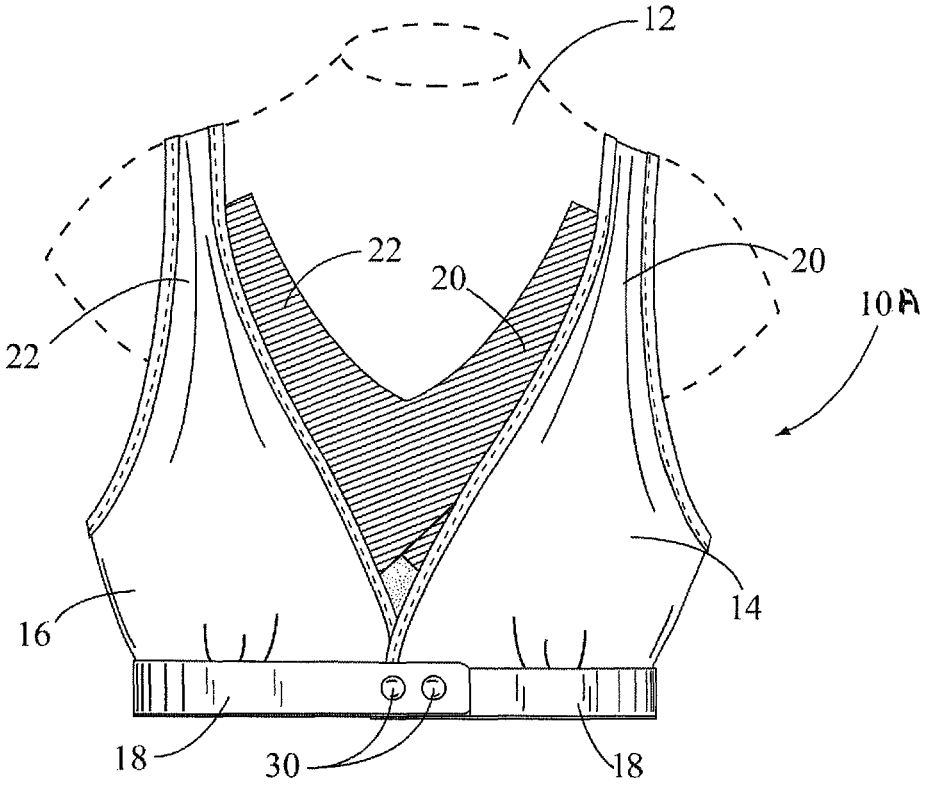
FIG. 4 is a front view of the subject sport bra.

In FIG. 4, a breast sport bra 10A is shown, without adjustable straps. In this embodiment, a pair of button snaps 30 are used to secure opposite ends of the breast cup band 18. Obviously, the button snaps 30 can be used for securing the shoulder straps 20 and 22, as shown in the drawings. Also, the button snaps are an example of various types of non-adjustable fasteners that can be used equally well on the breast cup band 18 or the shoulder straps 20 and 22. Further, the breast sport bra 10A can be used equally well without button snaps or other types of non-adjustable fasteners.

Figure 5:
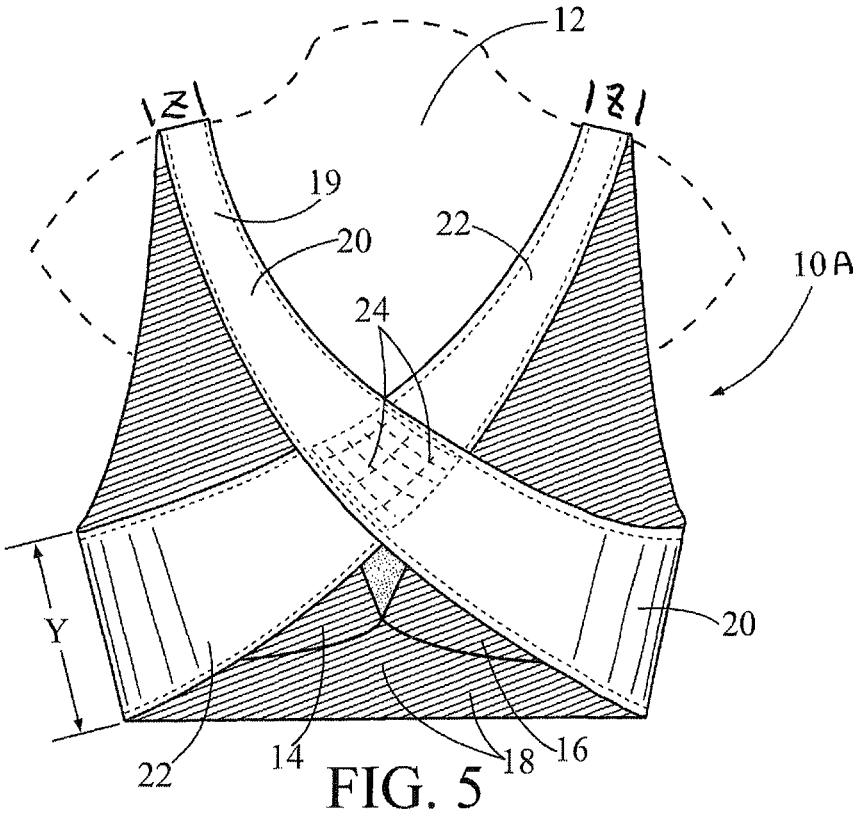
FIG. 5 is a rear view of the sport bra.

In FIG. 5, a rear view of the breast sport bra 10A is shown. In this view, the first shoulder strap 20 can be seen crossing the second shoulder strap 22, in an "X" configuration and attached using treaded stitching 24. As mentioned above, the crossing shoulder straps need not include the stitching. It should be noted, a bottom portion of the straps 20 and 22 have a width "Y" in a range from 3 to 4 inches in width and flare upwardly to a width "Z" in a range of ½ to 2 inches at a top portion of the straps. The feature of the shoulder straps provides for increased functional and breast support, breast balance, gravity balanced support, and increased comfort for the neck and shoulders. Also the width "Z" of the straps helps prevent the straps from digging into the top of the wearer's shoulders.

Figure 6:
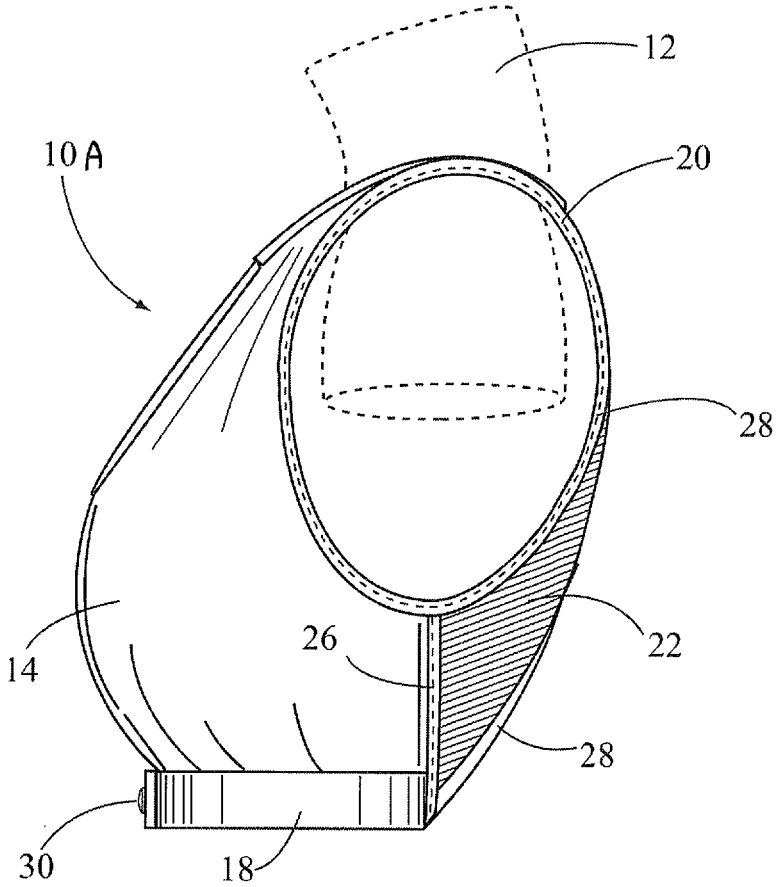
FIG. 6 is a side view of the sport bra.

In FIG. 6, a side view of the breast support bra 10A is shown with a bottom portion of the second shoulder strap 22 attached to a side of the first breast cup 14 and attached to an end of the breast cup band 18 using a cover stitch seam 26. Fabric edges 28 of the support bra 10 include bindings folded over the elastic band 18. This feature adds strength to the fabric of the bra material.

Figure 7:
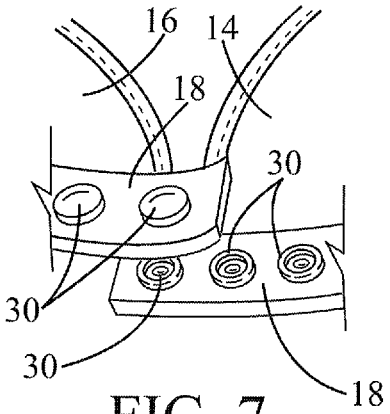
FIG. 7 is a perspective view of a pair of snap buttons for securing the breast cup band, shown in FIG. 4.

In FIG. 7, a perspective view of a pair of snap buttons 30 are illustrated for securing the breast cup band, shown in FIG. 4. While not shown in the drawings, the snap buttons 30 can be used for securing open ends of the first and second shoulder straps 20 and 22.

For determining a proper bra size, using the subject support bra or sport bra, without adjustable straps, the model 12 is first measured, using a tape measure, under the models breasts. Then the model 12 bends over 90 degrees from the vertical and the measuring tape is disposed around the front of the breasts and the back. In this manner, a better way is provided for determining a more comfortable and proper bra size for a wearer.

The invention has been particularly shown, described and illustrated in detail with reference to the preferred embodiments and modifications thereof, it should be understood by those skilled in the art that equivalent changes in form and detail may be made therein without departing from the true spirit and scope of the invention as claimed except as precluded by the prior art.

The embodiments of the invention for which as exclusive privilege and property right is claimed are defined as follows:

1. A breast support bra for providing a women wearer with a comfortable breast support, a balance of breasts, and freedom of movement, the breast support bra comprising:

a first breast cup;

a second breast cup, the first and second breast cups attached to a top portion of a breast cup band, the breast cup band releasably attached to the first and second breast cups;

a first shoulder strap, one end of the first shoulder strap is attached to a top portion of the first breast cup, an opposite end of the first shoulder strap attached to a side of the second breast cup and an end portion of the breast cup band; and a second shoulder strap, one end of the second shoulder strap is attached to a top portion of the second breast cup, an opposite end of the second shoulder strap crossing the first shoulder strap in an "X" configuration and attached to a side of the first breast cup and attached to an end portion of the breast cup band:

wherein a bottom portion of the first shoulder strap and a bottom portion of the second shoulder strap have a width in a range of 3 to 4 inches, the shoulder straps tapered upwardly to a width of ½ to 2 inches at a top of the shoulder straps for increased breast support and comfort against a shoulder and neck of the wearer.

2. The breast support bra as described in claim 1 wherein the breast cup band includes a breast cup buckle mounted on one end of the breast cup band, and hook and loop fasteners mounted on an opposite end of the breast cup band, the breast cup buckle used for releasable attachment of the breast cups attached to the breast cup band.

3. The breast support bra as described in claim 1 wherein the first shoulder strap is releasably attached to the first breast cup and the second shoulder strap is releasably attached to the second breast cup, the shoulder straps opened and closed using a shoulder strap buckle mounted on one end of the shoulder straps and hook and loop fasteners mounted on an opposite end of the shoulder straps.

4. A breast support bra for providing a women wearer with a comfortable breast support, a balance of breasts, and freedom of movement, the breast support bra comprising:

a first breast cup;

a second breast cup, the first and second breast cups attached to a top portion of horizontal, elastic, breast cup band, the breast cup band releasably to attached the first and second breast cups using a breast cup buckle;

a first shoulder strap, one end of the first shoulder strap attached to a top portion of the first breast cup, an opposite end of the first shoulder strap attached to a lower portion of the second breast cup and an end portion of the breast cup band; and a second shoulder strap, one end of the second shoulder strap attached to a top portion of the second breast cup, an opposite end of the second shoulder strap crossing the first shoulder strap in an "X" configuration and attached to a side of the first breast cup and an end portion of the breast cup band;

wherein a bottom portion of the first shoulder strap and the bottom portion of the second shoulder strap has a width in a range of 3 to 4 inches, the shoulder straps tapered upwardly to a width of ½ to 2 inches at the top of the shoulder straps for increased breast support and comfort against a back of the wearer.

5. The breast support bra as described in claim 4 wherein the first shoulder strap is releasably attached to the first breast cup and the second shoulder strap is releasably attached to the second breast cup, the shoulder straps opened and closed using a shoulder strap buckle mounted on one end of the shoulder straps and hook and loop fasteners mounted on an opposite end of the shoulder straps.

6. A breast sport bra for providing a women wearer with a comfortable breast support, a balance of breasts, and freedom of movement, the breast support bra comprising:

a first breast cup;

a second breast cup, the first and second breast cups attached to a top portion of horizontal, elastic, breast cup band, the breast cup band attached to the first and second breast cups;

a first shoulder strap, one end of the first shoulder strap attached to a top portion of the first breast cup, an opposite end of the first shoulder strap attached to a side of the second breast cup and an end portion of the breast cup band; and a second shoulder strap, one end of the second shoulder strap attached to a top portion of the second breast cup, an opposite end of the second shoulder strap crossing the first shoulder strap in an "X" configuration and attached to a side of the first breast cup and an end portion of the breast cup band;

wherein a bottom portion of the first shoulder strap and a bottom portion of the second shoulder strap has a width in a range of 3 to 4 inches, the shoulder straps tapered upwardly to a width of ½ to 2 inches at the top of the shoulder straps for increased breast support and comfort against a back of the wearer.

7. The breast sport bra as described in claim 6 further including one or more snap buttons attached to open ends of the breast cup band, the snap buttons used for securing the opposite ends of the breast cup band together.

* * * * *